US010046881B2

(12) United States Patent
Saito et al.

(10) Patent No.: US 10,046,881 B2
(45) Date of Patent: Aug. 14, 2018

(54) RESIN CONTAINER AND BAG-IN-BOX

(71) Applicant: NISSEI ASB MACHINE CO., LTD., Komoro-Shi, Nagano (JP)

(72) Inventors: Tatsuaki Saito, Komoro (JP); Toshiaki Misaizu, Komoro (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 54 days.

(21) Appl. No.: 14/913,293

(22) PCT Filed: Aug. 11, 2014

(86) PCT No.: PCT/JP2014/071227
§ 371 (c)(1),
(2) Date: Feb. 19, 2016

(87) PCT Pub. No.: WO2015/025771
PCT Pub. Date: Feb. 26, 2015

(65) Prior Publication Data

US 2016/0200495 A1 Jul. 14, 2016

(30) Foreign Application Priority Data

Aug. 22, 2013 (JP) ..... 2013-172650

(51) Int. Cl.
*B65D 1/02* (2006.01)
*B65D 21/02* (2006.01)
(Continued)

(52) U.S. Cl.
CPC ..... *B65D 1/0292* (2013.01); *B65D 1/0223* (2013.01); *B65D 1/0276* (2013.01);
(Continued)

(58) Field of Classification Search
CPC .. B65D 1/0292; B65D 21/0233; B65D 85/06; B65D 77/042; B65D 21/0231;
(Continued)

(56) References Cited

U.S. PATENT DOCUMENTS 2,641,374 A * 6/1953 Der Yuen ..... B65D 21/0231 206/509
3,690,500 A * 9/1972 Remane ..... B65D 21/0235 206/503
(Continued)

FOREIGN PATENT DOCUMENTS

CN 201178991 Y 1/2009
CN 101998924 A 3/2011
(Continued)

OTHER PUBLICATIONS

Chinese Patent Office Action dated Sep. 2, 2016 for Application No. 201480046552.4.
(Continued)

*Primary Examiner* — Anthony Stashick
*Assistant Examiner* — Mollie Impink
(74) *Attorney, Agent, or Firm* — David L. Hoffman; Hoffman Patent Group

(57) ABSTRACT

A resin container of the invention is the resin container capable of storing a predetermined amount of fluid having flexibility, the resin container including a first surface part formed with an inlet/outlet part for the fluid, a second surface part connected to the first surface part and forming a peripheral surface, and a third surface part arranged at an opposite side of the first surface part and connected to the second surface part, wherein the first surface part is formed with a first recess recessed from the first surface part toward a third surface part side, and the second surface part is formed with a second recess recessed toward the center of
(Continued)

the container from the first surface part to the third surface part.

14 Claims, 5 Drawing Sheets

(51) Int. Cl.
*B65D 1/44* (2006.01)
*B65D 23/10* (2006.01)
*B65D 77/04* (2006.01)
*B65D 85/62* (2006.01)

(52) U.S. Cl.
CPC ..... *B65D 1/44* (2013.01); *B65D 21/0231* (2013.01); *B65D 21/0233* (2013.01); *B65D 23/102* (2013.01); *B65D 77/0426* (2013.01); *B65D 85/62* (2013.01); *B65D 2501/0036* (2013.01); *B65D 2501/0081* (2013.01)

(58) Field of Classification Search
CPC ..... B65D 21/08; B65D 77/0426; B65D 1/44; B65D 11/246; B65D 23/102; B65D 2501/0081; B65D 2501/0027; B65D 2501/0036
USPC ..... 206/499; 220/670, 672, 675; 215/382
See application file for complete search history.

(56) References Cited

U.S. PATENT DOCUMENTS 4,805,793 A * 2/1989 Brandt ..... B65D 21/0231 206/509
5,064,101 A * 11/1991 Richter ..... B65D 1/20 141/351
5,174,458 A 12/1992 Segati
5,330,050 A * 7/1994 Stansbury, Jr. ..... B65D 71/70 206/386
6,527,133 B1 * 3/2003 McCollum ..... B65D 1/0223 215/382
7,467,714 B2 * 12/2008 Slat ..... B65D 21/0224 206/499
8,235,214 B2 * 8/2012 Eiten ..... B65D 19/0036 206/499
8,439,214 B2 * 5/2013 Darr ..... B65D 1/0223 215/375
8,561,822 B2 * 10/2013 Beck ..... B65D 1/44 215/370
8,746,453 B1 * 6/2014 Hall ..... B65D 21/0202 206/504
2001/0045370 A1 * 11/2001 Soehnlen ..... B65D 1/20 206/427
2003/0132184 A1 * 7/2003 Dorn ..... B65D 1/18 215/10
2007/0114200 A1 * 5/2007 Lane ..... B65D 1/023 215/10
2007/0272705 A1 11/2007 Beine et al.

FOREIGN PATENT DOCUMENTS

CN 202337412 U 7/2012
JP 53131903 U1 10/1978
JP 05270592 A 10/1993
JP 09040016 A 2/1997
JP 2001111228 A 4/2001
JP 2001199443 A 7/2001
JP 2006103758 A 4/2006
JP 2006131277 A 5/2006
JP 4084342 B2 4/2008
JP 4113871 B2 7/2008
JP 2010042859 A 2/2010
JP 2011131890 A 7/2011
JP 2011176407 A 9/2011
WO WO2005007385 A1 1/2005

OTHER PUBLICATIONS

International Search Report dated Oct. 14, 2014 for Application No. PCT/JP2014071227.
International Search Opinion dated Oct. 14, 2014 for Application No. 2014071227.
Japanese Office Action dated May 23, 2017 for Application No. 2013-172650.
Korean Office Action dated May 31, 2017 for Application No. 20167004536.

* cited by examiner

RESIN CONTAINER AND BAG-IN-BOX

TECHNICAL FIELD

The present invention relates to a resin container filled with fluid such as liquid, powder or grains, and a bag-in-box.

BACKGROUND ART

A container used in a water server etc. is often a container molded using a polycarbonate (PC) resin having high strength as a raw material. However, since the container made of this polycarbonate resin has low flexibility, large space is required in a case of storing an empty container.

Because of this, a container having flexibility, which is molded of a softer raw material, has become widespread (for example, see Patent References 1 and 2). According to this soft container, at the time of storage or discard, the volume of the container can be reduced and further, at the time of use, the container is naturally crushed under atmospheric pressure with an outflow of liquid. Therefore, it is unnecessary to introduce air into the inside with a reduction in liquid, and the container is superior from a hygiene standpoint. However, since this soft container has low durability alone, it is difficult to handle the container in a state filled with the liquid.

Hence, a so-called bag-in-box for supplementing the durability of the container by storing the soft container in an outer box made of a cardboard box is developed (for example, see Patent Reference 3). In this bag-in-box, normally, the container is taken out of the outer box, and the container is installed by inserting the container into a box-shaped storage part of a water server from above with a mouth part provided on an upper portion of the container turned downwardly.

PRIOR ART REFERENCE

Patent Reference

Patent Reference 1: Japanese Patent No. 4084342
Patent Reference 2: Japanese Patent No. 4113871
Patent Reference 3: JP-A-H09-40016

DISCLOSURE OF THE INVENTION

Problems that the Invention is to Solve

Incidentally, in the bag-in-box described above, in the case of taking the container out of the outer box and installing the container in the box-shaped storage part of the water server, there is no gap for putting a hand between the container and the outer box or the storage part. Therefore, it is difficult to take out the container out of the outer box and install the container in the storage part of the water server. Also, since the container taken out of the outer box is difficult to hold, workability of a process in which the container taken out of the outer box is vertically reversed and is inserted into the storage part of the water server is not good.

An object of the invention is to provide a resin container having flexibility with good handleability, and a bag-in-box including the resin container.

Means for Solving the Problems

A resin container of the invention capable of solving the above-described problem is the resin container capable of storing a predetermined amount of fluid and having flexibility, the resin container including:

a first surface part formed with an inlet/outlet part for the fluid;

a second surface part connected to the first surface part and forming a peripheral surface; and a third surface part arranged at an opposite side of the first surface part and connected to the second surface part, characterized in that:

the first surface part is formed with a first recess recessed from the first surface part toward a third surface part side, and the second surface part is formed with a second recess recessed toward the center of the container from the first surface part to the third surface part.

According to the resin container with this configuration, a hand can reach the bottom of the container by moving the arm along the second recess of the second surface part even in a state where the periphery is surrounded. Accordingly, the resin container can easily be taken in and out of an outer box, a storage part of a water server, etc.

Also, the resin container can be grasped easily and stably by inserting the hand into the first recess of the first surface part arranged at the downward side when downwardly turning the inlet/outlet part and grasping the resin container. Accordingly, the grasping can be eased without increasing cost as compared with a case of providing an accessory component such as a handle.

In the resin container of the invention, it is preferable that the third surface part is formed with a third recess recessed from the third surface part toward the first surface part.

According to the resin container with this configuration, the container can surely be grasped by putting the hand around the third surface part and inserting the hand into the third recess.

A bag-in-box of the invention includes an outer box, characterized in that:

a plurality of the above-described resin containers are stored in the outer box in a state of being stacked on each other.

According to the bag-in-box with this configuration, the inlet/outlet part of the resin container of the lower side can be arranged inside the third recess of the resin container of the upper side without interference. Accordingly, the third surface part of the resin container of the upper side is arranged on the first surface part of the resin container of the lower side, and the resin container of the upper side is stacked on the resin container of the lower side stably without a gap. Also, in a state where the resin containers are stored in the outer box, between the resin container and the outer box, a gap is vertically formed by the second recess of the resin container. Consequently, by inserting the arm into this gap, the hand is put around the third surface part of the resin container and the hand is inserted into the third recess, and the resin container can surely be grasped. Accordingly, the bag-in-box in which the resin container can be easily taken in and out of the outer box can be provided.

Advantage of the Invention

The invention provides the resin container having flexibility with good handleability, and the bag-in-box including the resin container.

MODE FOR CARRYING OUT THE INVENTION

An example of an embodiment of a resin container and a bag-in-box according to the invention will hereinafter be described with reference to the drawings.

Figure 1:
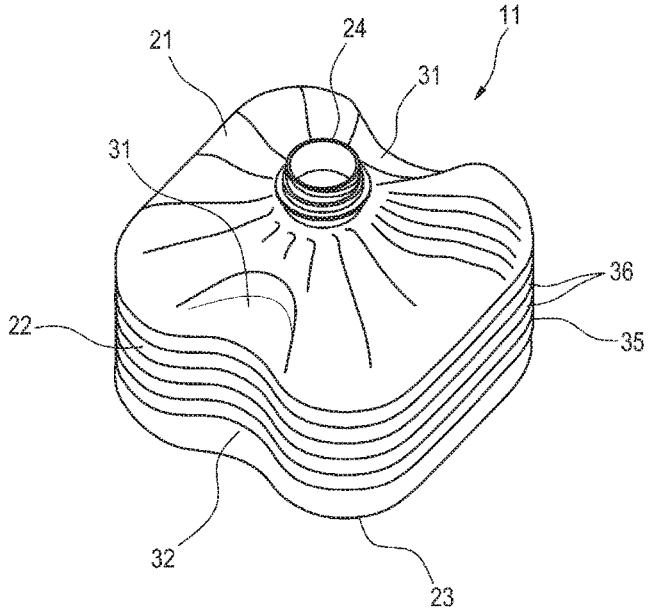
FIG. 1 is a perspective view of a resin container according to the present embodiment.
Figure 2:
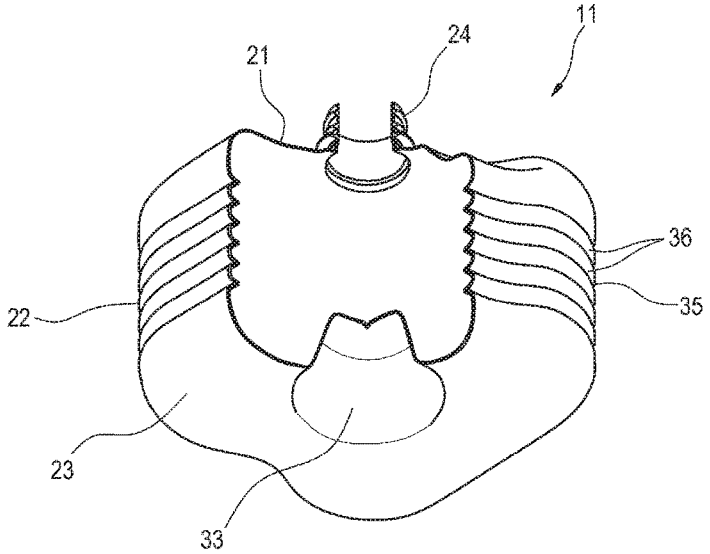
FIG. 2 is a partially perspective view in a case of viewing the resin container according to the embodiment from the downward side in a cross sectional view.
Figure 3:
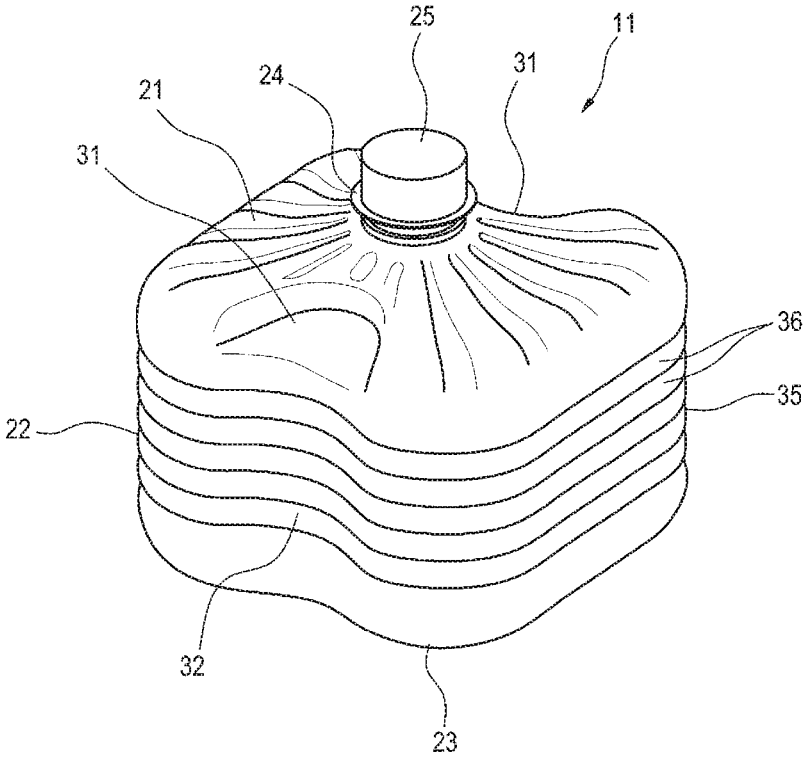
FIG. 3 is a perspective view of the resin container with a cap attached.

FIG. 1 is a perspective view of a resin container according to the present embodiment. FIG. 2 is a partially perspective view in a case of viewing the resin container according to the embodiment from the downward side in a cross sectional view. FIG. 3 is a perspective view of the resin container with a cap attached.

As shown in FIGS. 1 and 2, a resin container 11 is formed in a substantially cubic shape including a first surface part 21, a second surface part 22 and a third surface part 23, and a predetermined amount of liquid can be stored inside the resin container 11. The liquid stored in this resin container 11 mainly includes liquid such as water. Moreover, fluid such as powder or grains in addition to the liquid can be stored in the resin container 11. This resin container 11 is, for example, a thin-walled container formed by molding a material such as polyethylene terephthalate (PET) having flexibility by a blow molding machine. Accordingly, the resin container 11 is a container having flexibility and capable of reducing the volume at the time of storage or discard. In this way, since the resin container 11 is the thin-walled container having flexibility, the resin container 11 is particularly used as a disposable (one-way) container crushed and discarded after use.

The first surface part 21 forms a top surface of the resin container 11, and the center of the first surface part 21 is formed with a tubular inlet/outlet part 24 protruding upwardly. The liquid flows into the resin container 11 from the inlet/outlet part 24. Also, the liquid inside the resin container 11 flows out from the inlet/outlet part 24. As shown in FIG. 3, a cap 25 is attached to the inlet/outlet part 24. This cap 25 can be attached to and detached from the inlet/outlet part 24, and by mounting the cap 25 to the inlet/outlet part 24, the resin container 11 can be sealed.

The second surface part 22 forms a peripheral surface of the resin container 11, is connected to the first surface part 21, and extends to the downward side. The third surface part 23 forms a bottom surface of the resin container 11, is arranged in the side opposite to the first surface part 21, and is connected to the second surface part 22.

The first surface part 21 is formed with two first recesses 31. These first recesses 31 are formed in opposed positions between which the inlet/outlet part 24 is sandwiched. Each of these first recesses 31 is a recess which is recessed from the first surface part 21 toward the third surface part 23 side and in which the second surface part 22 side is opened.

The second surface part 22 is formed with two second recesses 32. These second recesses 32 are formed in the same positions as those of the first recesses 31 in a circumferential direction of the resin container 11 to be continuous therefrom, and are formed so as to be recessed toward the center of the resin container 11 from the first surface part 21 to the third surface part 23. Each of the second recesses 32 is formed in a shape recessed in a circular arc shape toward the center of the resin container 11 in a plan view of the resin container 11.

The third surface part 23 is formed with a third recess 33. This third recess 33 is formed in the center of the resin container 11, and is formed so as to be recessed from the third surface part 23 toward the first surface part 21. This third recess 33 is recessed in a size substantially not interfering with the inlet/outlet part 24 of the resin container 11 of the lower side in a case of vertically stacking the resin containers 11.

Also, the resin container 11 is formed with a bellows part 35 on the second surface part 22. This bellows part 35 has a plurality of groove parts 36 formed in the circumferential direction of the resin container 11, and these groove parts 36 are equally spaced in a vertical direction of the resin container 11.

The resin container 11 described above is inserted into a box-shaped storage part of a water server etc. in a state reversed vertically. Then, in this state, water, which is liquid inside the container, is supplied from the inlet/outlet part 24 of the resin container 11 to the water server.

When water is consumed in the water server and the water of the inside of the resin container 11 is reduced, the soft resin container 11 having flexibility is accordingly deformed and reduced in volumetric capacity. Consequently, air does not enter the inside of the resin container 11 with the reduction of the water, thereby ensuring hygiene. At this time, since the resin container 11 is formed with the bellows part 35 on the second surface part 22 which is the peripheral surface, the bellows part 35 is easily deformed with the reduction in the water.

Figure 4:
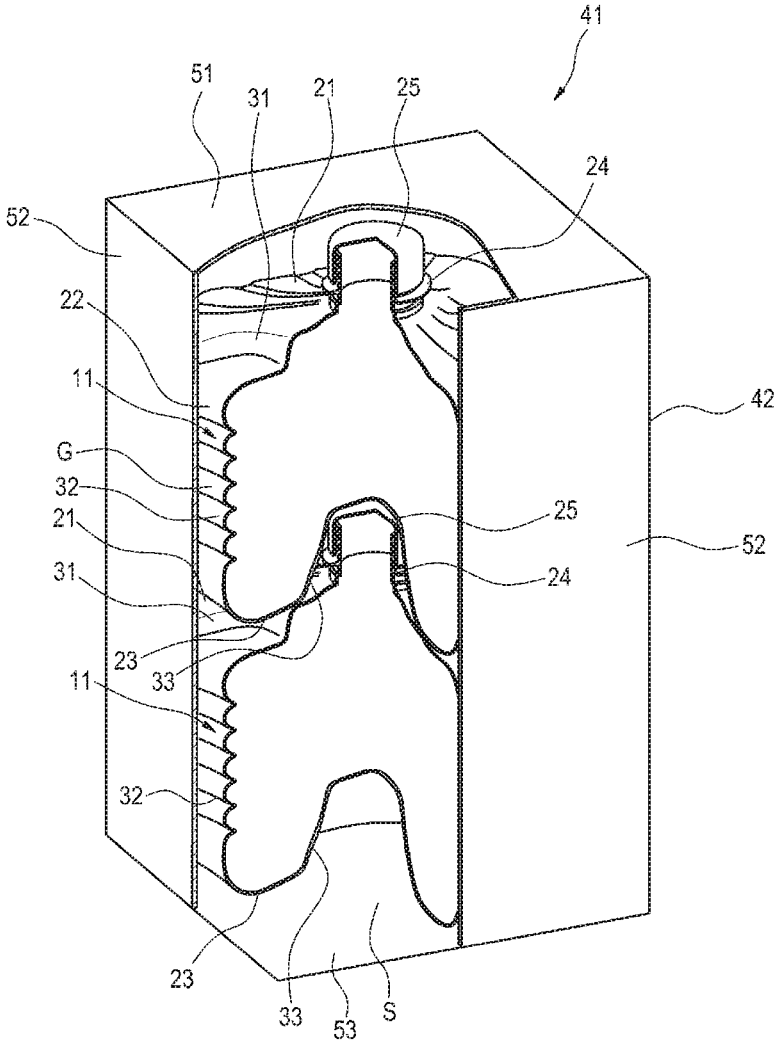
FIG. 4 is a partially perspective view showing a bag-in-box according to the embodiment in a cross sectional view.
Figure 5:
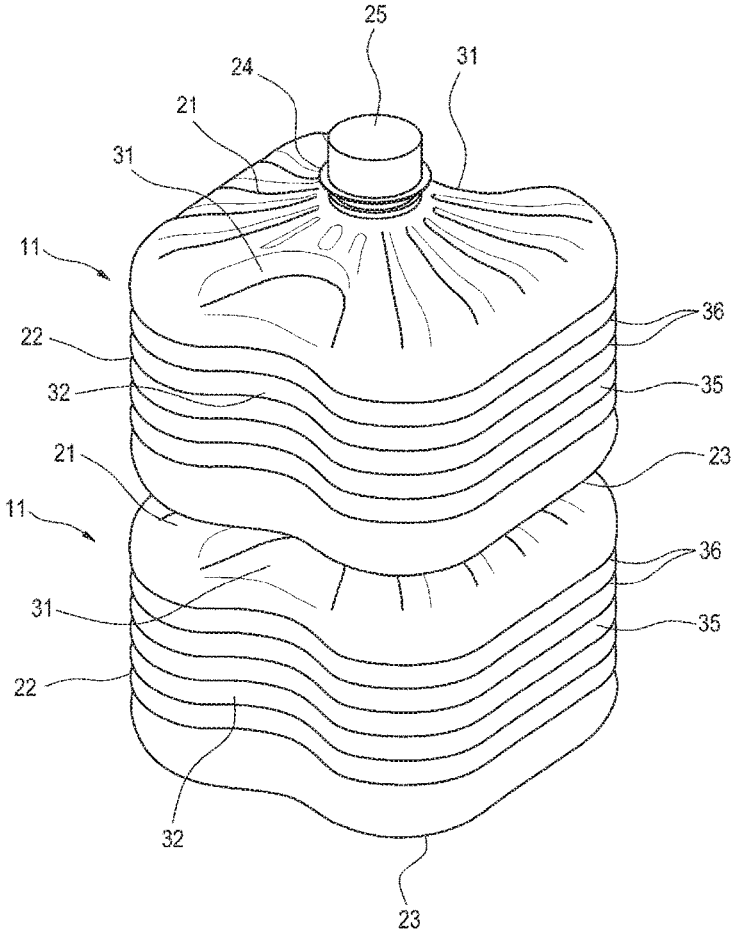
FIG. 5 is a perspective view of the resin containers stacked and stored inside a storage space of an outer box.
Figure 6:
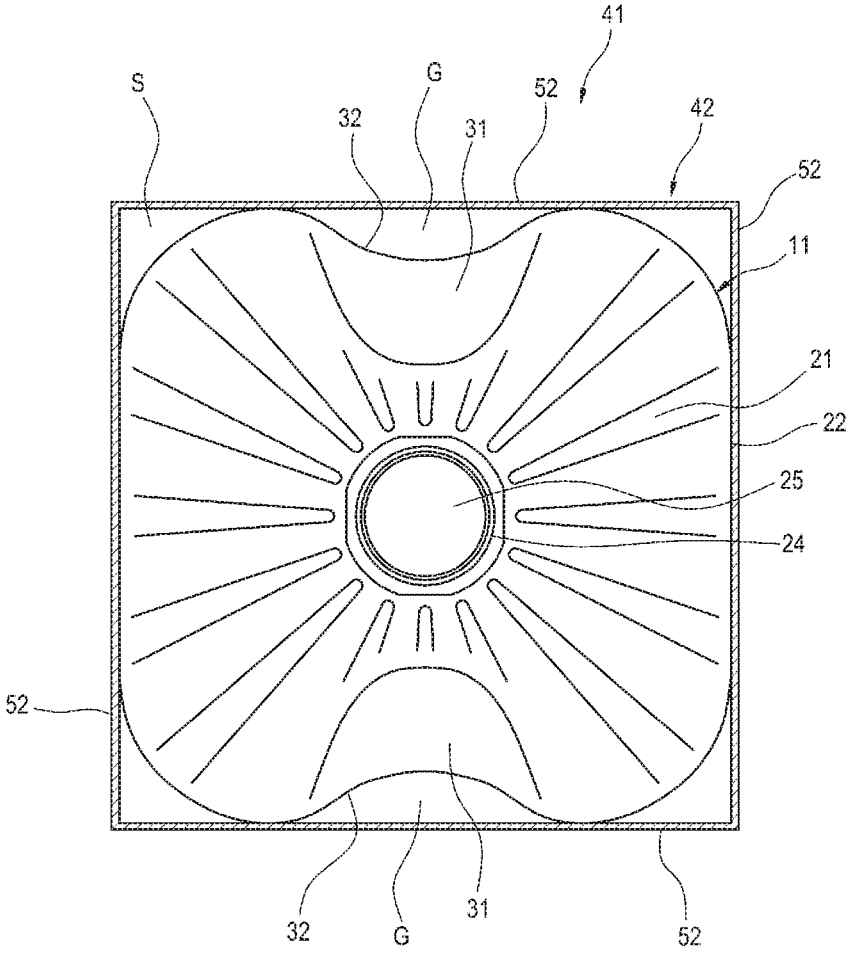
FIG. 6 is a plan view in a state where an upper surface plate part of the bag-in-box is detached.

FIG. 4 is a partially perspective view showing a bag-in-box according to the embodiment in a cross sectional view. FIG. 5 is a perspective view of the resin containers stacked and stored inside a storage space of an outer box. FIG. 6 is a plan view in a state where an upper surface plate part of the bag-in-box is detached.

As shown in FIG. 4, a bag-in-box 41 has an outer box 42 whose inside has a storage space S, and the two resin containers 11 are stored in the storage space S of the outer box 42. Further, in this bag-in-box 41, the thin-walled resin container 11 having flexibility is reinforced by the outer box 42. Accordingly, in the bag-in-box 41, the resin containers 11 can be conveyed and stored easily and without damage.

The outer box 42 is formed of, for example, cardboard or pasteboard, and has a cubic shape. The outer box 42 includes a rectangular upper surface plate part 51 that forms an upper surface, a quadrilateral-tubular side surface plate part 52 which is connected to the outer edge of this upper surface plate part 51, extends downwardly, and forms a side surface, and a rectangular bottom surface plate part 53 which is connected to the lower end of the side surface plate part 52 and forms a bottom surface. The upper surface plate part 51 of the outer box 42 can be opened and closed, and the resin container 11 can be taken in and out of the outer box 42 with this upper surface plate part 51 opened.

As shown in FIG. 5, the two resin containers 11 are stored in the storage space S of the outer box 42 with the resin containers 11 stacked on each other. In this state, the inlet/outlet part 24 of the resin container 11 of the lower side is arranged inside the third recess 33 of the resin container 11 of the upper side without interference. Accordingly, the third surface part 23 of the resin container 11 of the upper side is arranged on the first surface part 21 of the resin container 11 of the lower side, and the resin container 11 of the upper side is stacked on the resin container 11 of the lower side stably without a gap.

As shown in FIG. 6, in a state where the resin container 11 stored in the storage space S of the outer box 42, gaps G are vertically formed by the second recesses 32 of the resin container 11 between the resin container 11 and the side surface plate part 52 of the outer box 42.

Next, the case of taking the resin container 11 out of the bag-in-box 41 and installing the resin container 11 in the storage part of the water server will be described.

A worker opens the upper surface plate part 51 of the outer box 42 of the bag-in-box 41 and takes out the resin container 11 stored in the storage space S of the outer box 42. Here, between the resin container 11 and the side surface plate part 52 of the outer box 42, the gaps G are vertically formed by the second recesses 32 of the resin container 11. Consequently, the worker can insert the arm into the gap G between the outer box 42 and the resin container 11 along the second recess 32 of the resin container 11 to easily make the hand reach the third surface part 23 which is the bottom surface of the resin container 11.

The worker puts the hand around the third surface part 23 of the resin container 11, and grasps the resin container 11 so as to hold the resin container 11, and pulls up the resin container 11 to thereby take the resin container 11 out of the outer box 42. Here, since the third surface part 23 which is the bottom surface of the resin container 11 is formed with the third recess 33 recessed toward the first surface part 21 which is the upper side, the worker can surely grasp the resin container 11 by inserting the hand into this third recess 33.

Then, in order to turn the inlet/outlet part 24 to the downward side, the worker vertically reverses the resin container 11 and grasps the resin container 11 in this state. Here, since the first surface part 21 of the resin container 11 is formed with the first recess 31 recessed toward the third surface part 23 side, with respect to the vertically reversed resin container 11, the worker can grasp the resin container 11 easily and stably by inserting the hand into the first recess 31 arranged in the downward side.

Then, while grasping the vertically reversed resin container 11, the worker lowers this resin container 11 from the upward side to the box-shaped storage part of the water server and stores the resin container 11. Here, since a gap made of the second recess 32 formed in the second surface part 22 is vertically formed between the resin container 11 and an inner wall of the storage part, by inserting the resin container 11 into the storage part while inserting the arm into its gap, the worker can smoothly store the resin container 11 in the storage part without pinching the arm between the resin container 11 and the inner wall of the storage part.

According to the resin container 11 according to the embodiment as described above, the hand can reach the bottom of the resin container 11 by moving the arm along the second recess 32 of the second surface part 22 even in a state where the periphery is surrounded. Accordingly, the resin container 11 can easily be taken in and out of the outer box 42, the storage part of the water server, etc.

Also, the resin container 11 can be grasped easily and stably by inserting the hand into the first recess 31 of the first surface part 21 arranged at the downward side in the case of downwardly turning the inlet/outlet part 24 and grasping the resin container 11. Accordingly, the grasping can be eased without increasing cost as compared with a container having a bottom surface portion provided with a handle capable of being grasped in the case of being vertically reversed.

Also, since the third surface part 23 is formed with the third recess 33 recessed from the third surface part 23 toward the first surface part 21, the resin container 11 can surely be grasped by putting the hand around the third surface part 23 and inserting the hand into the third recess 33.

Also, according to the bag-in-box 41 according to the embodiment, the resin containers 11 stacked on each other do not have an accessory member such as a handle on the third surface part 23 constructing the bottom surface of the resin container 11, and have the third recess 33 recessed to the first surface part 21 side. Consequently, the inlet/outlet part 24 of the resin container 11 of the lower side can be arranged inside the third recess 33 of the resin container 11 of the upper side without interference. Accordingly, the third surface part 23 of the resin container 11 of the upper side is arranged on the first surface part 21 of the resin container 11 of the lower side, and the resin container 11 of the upper side is stacked on the resin container 11 of the lower side stably without a gap. That is, the inlet/outlet part 24 of the resin container 11 of the lower side does not interfere with the resin container 11 of the upper side, and the upper and lower resin containers 11 can be stably stacked and stored in the outer box 42.

Also, in a state where the resin containers 11 are stored in the outer box 42, between the resin container 11 and the outer box 42, the gaps G are vertically formed by the second recesses 32 of the resin container 11. Consequently, even in the state where the resin containers 11 are stacked and stored, by inserting the arm into the gap G between the resin container 11 and the outer box 42, the hand is put around the third surface part 23 of the resin container 11 and the hand is inserted into the third recess 33, and the resin container 11 can surely be grasped. Accordingly, the bag-in-box 41 in which the resin container 11 can be easily taken in and out of the outer box 42 can be provided.

Also, in the resin container 11, the corner portion resistant to bulging by the pressure of filled water makes contact with the outer box 42. Further, even when the second surface part 22 of the resin container 11 bulges by the pressure of the filled water, the center of the second surface part 22 of the resin container 11 is formed with the second recess 32 along the vertical direction. Therefore, the outer box 42 can be prevented from being pushed out from the inside by the resin container 11, and deformation of the bag-in-box 41 can be reduced.

In this way, the embodiment described above can provide the resin container 11 having flexibility with good handleability, and the bag-in-box 41 including the resin container 11.

Here, the invention is not limited to the embodiment described above, and changes, improvements, etc. can be made appropriately. Moreover, as long as the invention can be achieved, materials, shapes, dimensions, numerical values, forms, the number of components, arrangement places of each component in the embodiment described above are freely arbitrary and are not limited.

The invention has been described in detail with reference to the specific embodiment, but it is apparent to those skilled in the art that various changes or modifications can be made without departing from the spirit and scope of the invention.

The present application is based on Japanese patent application (patent application No. 2013-172650) filed on Aug. 22, 2013, and the contents of the patent application are hereby incorporated by reference.

DESCRIPTION OF REFERENCE NUMERALS AND SIGNS

11: RESIN CONTAINER
21: FIRST SURFACE PART

22: SECOND SURFACE PART
23: THIRD SURFACE PART
24: INLET/OUTLET PART
31: FIRST RECESS
32: SECOND RECESS
33: THIRD RECESS
41: BAG-IN-BOX
42: OUTER BOX

The invention claimed is:

1. A resin container capable of storing a predetermined amount of fluid and having flexibility, the resin container comprising:

a first surface part formed with an inlet/outlet part for the fluid;

a second surface part connected to the first surface part and forming a peripheral surface extending in a circumferential direction of the container; and a third surface part arranged at an opposite side of the container from the first surface part and connected to the second surface part, wherein the first surface part is formed with a first recess recessed from the first surface part toward a third surface part side, and wherein the second surface part is formed with a second recess recessed toward the center of the container and extending from the first surface part to the third surface part, wherein the second recess has a recessed circular arc shape, wherein the second recess is formed in the same position as the first recess with respect to the circumferential direction of the resin container and the second recess is contiguous with the first recess, wherein a bottom surface of the first recess is substantially perpendicular to the second surface part, wherein a plurality of groove parts are formed in a circumferential direction of the resin container on the second surface part, and wherein the plurality of groove parts are continuously formed in the circumferential direction around an entire circumference of the resin container and are formed along a recessed surface of the second recess.

2. The resin container according to claim 1, wherein the third surface part is formed with a third recess recessed from the third surface part toward the first surface part.

3. The resin container according to claim 2, wherein the second recess and the third recess are contiguous.

4. The resin container according to claim 1, wherein the container has no separately attached handle.

5. The resin container according to claim 1, wherein there is an additional first recess and an additional second recess formed on an opposite side of the container from the first recess and the second recess.

6. The resin container according to claim 1, wherein a length of the second recess extends substantially parallel to a central axis of the container.

7. A bag in combination of an outer box and a plurality of containers, the combination, comprising the outer box having side plates, and containing therein a plurality of resin containers, each of the resin containers being capable of storing a predetermined amount of fluid and having flexibility, and the containers being vertically stacked, each of the resin containers comprising:

a first surface part formed with an inlet/outlet part for the fluid;

a second surface part connected to the first surface part and forming a peripheral surface extending in a circumferential direction of the container; and a third surface part arranged at an opposite side of the container from the first surface part and connected to the second surface part, wherein the first surface part is formed with a first recess recessed from the first surface part toward a third surface part side, and wherein the second surface part is formed with a second recess recessed toward the center of the container and extending from the first surface part to the third surface part, wherein the second recess has a recessed circular arc shape, wherein the second recess is formed in the same position as the first recess with respect to the circumferential direction of the resin container and the second recess is contiguous with the first recess, wherein the third surface part is formed with a third recess recessed from the third surface part toward the first surface part, wherein a bottom surface of the first recess is substantially perpendicular to the second surface part, wherein a plurality of groove parts are formed in a circumferential direction of the resin container on the second surface part, and wherein the plurality of groove parts are continuously formed in the circumferential direction around an entire circumference of the resin container and are formed along a recessed surface of the second recess.

8. The combination of claim 7, wherein the second recess is contiguous with the third recess.

9. The combination of claim 8, wherein the container has no separately attached handle.

10. The combination of claim 8, wherein there is an additional first recess and an additional second recess formed on an opposite side of the container from the first recess and the second recess.

11. The combination of claim 10, wherein the second recess and the additional second recess form gaps between a corresponding one of the side plates and the container.

12. The combination of claim 7, wherein each of the containers have no separately attached handle.

13. The combination of claim 7, wherein each of the containers are filled with water.

14. The combination of claim 7, wherein in each of the containers, a length of the second recess extends substantially parallel to a central axis of the container.

* * * * *